US006349523B1

(12) United States Patent
Jostler et al.

(10) Patent No.: US 6,349,523 B1
(45) Date of Patent: Feb. 26, 2002

(54) WEB FOR PACKAGE BLANKS

(75) Inventors: Jan Jostler; Ingemar Broden, both of Halmstad (SE)

(73) Assignee: Joker System Aktiebolag, Halmstad (SE)

( * ) Notice: Subject to any disclaimer, the term of this patent is extended or adjusted under 35 U.S.C. 154(b) by 0 days.

(21) Appl. No.: 09/469,101

(22) Filed: Dec. 21, 1999

Related U.S. Application Data

(62) Division of application No. 09/051,097, filed as application No. PCT/SE96/01247 on Oct. 3, 1996, now Pat. No. 6,021,628.

(30) Foreign Application Priority Data

Oct. 5, 1995 (SE) ..... 9503451

(51) Int. Cl.[7] ..... B65B 43/38
(52) U.S. Cl. ..... 53/384.1; 53/570
(58) Field of Search ..... 53/384.1, 492, 53/468, 469, 570

(56) References Cited

U.S. PATENT DOCUMENTS

| | | | | |
|---|---|---|---|---|
| 3,599,388 A | | 8/1971 | Feingold | 53/29 |
| 3,813,845 A | | 6/1974 | Weikert | 53/37 |
| 4,169,345 A | * | 10/1979 | Douwenga | |
| 4,514,962 A | | 5/1985 | Ausnit | 53/457 |
| 4,558,556 A | | 12/1985 | Jostler | 53/459 |
| 4,630,311 A | | 12/1986 | Benton | 383/37 |
| 4,654,878 A | | 3/1987 | Lems | 383/37 |
| 4,665,552 A | | 5/1987 | Lems et al. | 383/37 |
| 4,798,041 A | * | 1/1989 | Bentsen | |
| 4,832,505 A | | 5/1989 | Ausnit et al. | 383/5 |
| 4,850,178 A | * | 7/1989 | Ausnit | |
| 4,945,714 A | | 8/1990 | Bodolay et al. | 53/568 |
| 5,337,539 A | | 8/1994 | Barton | 53/413 |
| 5,519,982 A | | 5/1996 | Herber et al. | 53/412 |
| 5,704,192 A | * | 1/1998 | Jostler et al. | |
| 5,733,045 A | | 3/1998 | Jostler et al. | 383/37 |
| 5,743,070 A | * | 4/1998 | Lerner et al. | |
| 5,814,382 A | | 9/1998 | Yannuzzi, Jr. | 428/34.3 |

FOREIGN PATENT DOCUMENTS

| | | |
|---|---|---|
| WO | 8200129 | 1/1982 |
| WO | 9425365 | 11/1994 |

* cited by examiner

*Primary Examiner*—Eugene Kim
(74) *Attorney, Agent, or Firm*—Ladas & Parry

(57) ABSTRACT

A web (20) of sequentially disposed package blanks (26) are supplied to an apparatus for opening and closing the package blanks at a filling station. The web has a first wall (21 *a*) opposite a second wall (21*b*). Transverse slits (27) are disposed between the side closures of the package blanks. Each respective wall is provided with retainers at its upper edges which guide the edges when the web is displaced along the apparatus. The wall (21*a, b*) of each package blank is provided with a longitudinal slit (29*a*). The slit (29*a*) of the first wall extends from the transverse slit (27) at one side closure of the package blank, and the longitudinal slit of the second wall extends from the transverse slit at the second side closure of the package blank. The apparatus includes mechanical retainer devices which are disposed in transversely spaced relation from one another in that part of the apparatus where the package blanks are displaced in the opened state so that the blanks can be filled. Guide members (35*a, b*; 36*a, b*) displace the edge portions (24*a, b*) of the web (20) longitudinally in relation to one another when the package blanks are opened so that a rectangular opening is formed.

6 Claims, 8 Drawing Sheets

WEB FOR PACKAGE BLANKS

This application is a divisional of application No. 09/051,097 filed on Apr. 1, 1998, International Application PCT/SE96/01247 filed on Oct. 3, 1996 now U.S. Pat. No. 6,021,628 and which designated the U.S., claims the benefit thereof and incorporates the same by reference.

FIELD OF THE INVENTION

The present invention relates to a web comprising mutually sequentially arranged package blanks (pockets) according to the preamble to the appended independent claim.

There are needs in the art for a web comprising mutually sequentially disposed pockets in which the web is disposed to be moved along mechanical retainer devices which, during a part of the displacement, hold the pockets in the opened position in order to make it possible to supply contents into the pockets, whereafter the retainer devices, on continued movement of the web, hold the pockets in a position in which closure of the pockets takes place.

Patent specification EP-B1 0 054 564 describes a web of the above-indicated type. The web displays two opposing walls and longitudinal first (lower) and second (upper) edges. The web comprises mutually sequentially disposed pockets, with a bottom portion at the first edge and two connecting zones which are transverse in relation to the longitudinal direction of the web and which form side closures of the pockets. Transverse slits are provided between the connecting zones in two adjacent pockets in order to separate the pockets from one another.

The web according to EP-B1 0 054 564 includes two substantially opposing strip portions which extend in the longitudinal direction of the web at its above-mentioned second edge. Each strip portion is provided with a continuous retainer device for cooperation with mechanical guide means for holding the strip portions in spaced apart relationship from one another and thereby holding the pockets in opened position in connection with contents being supplied into the pockets. In both walls, the web is provided with slits disposed in the longitudinal direction of the web, the slits for each wall being symmetrically located on either side of the transverse slits.

In purely practical terms, it has proved that the walls of the web in the web described in EP-B1 0 054 564, on movement along the mechanical retainer devices, show a tendency to undesirable displacement in relation to one another in the longitudinal direction of the web. When such mutually displaced walls are moved to positions adjacent one another for closure of the pockets, creases are readily formed in those regions where the closure is to take place. Such crease formations generally entail that an unacceptable closure is formed on fusion of the strip walls. A further drawback inherent in the prior art web is that the edges located transversely of the longitudinal direction of the web often form undesirable inward or outward bulges in the opened pockets. Such inward and outward bulges lead to problems in the supply of contents into the pockets, for which reason correction must be made of the shape of the openings using mechanical devices which are introduced down into the openings and move the edges to positions in which filling and closure of the pockets are not jeopardized.

SUMMARY OF THE INVENTION

The present invention relates to a web and an apparatus for supplying contents to package blanks included in the web, in which the above-drawbacks have been obviated.

This is attained by means of a construction according to the invention in which the longitudinal slits in the walls of the package blank extend in opposite directions at the side closure edges and mechanical retainer devices are disposed at upper edges of the package blank to open the mouth of the package blank to fill the package blank, and guide devices are provided at the inlet end of the filling region to provide relative longitudinal displacement between the upper edge of one wall and the upper edge of the other wall so that the mouth of the package blank can form a rectangular opening. Guide devices are also provided at the outlet end of the filling region to return the upper edges of the walls of the package blanks to their original opposed relation.

BRIEF DESCRIPTION OF THE DRAWINGS

The present invention will now be described in greater detail hereinbelow, with particular reference to the accompanying Drawings, in which.

DETAILED DESCRIPTION

Figures 1, 1A, 1B, 1C:
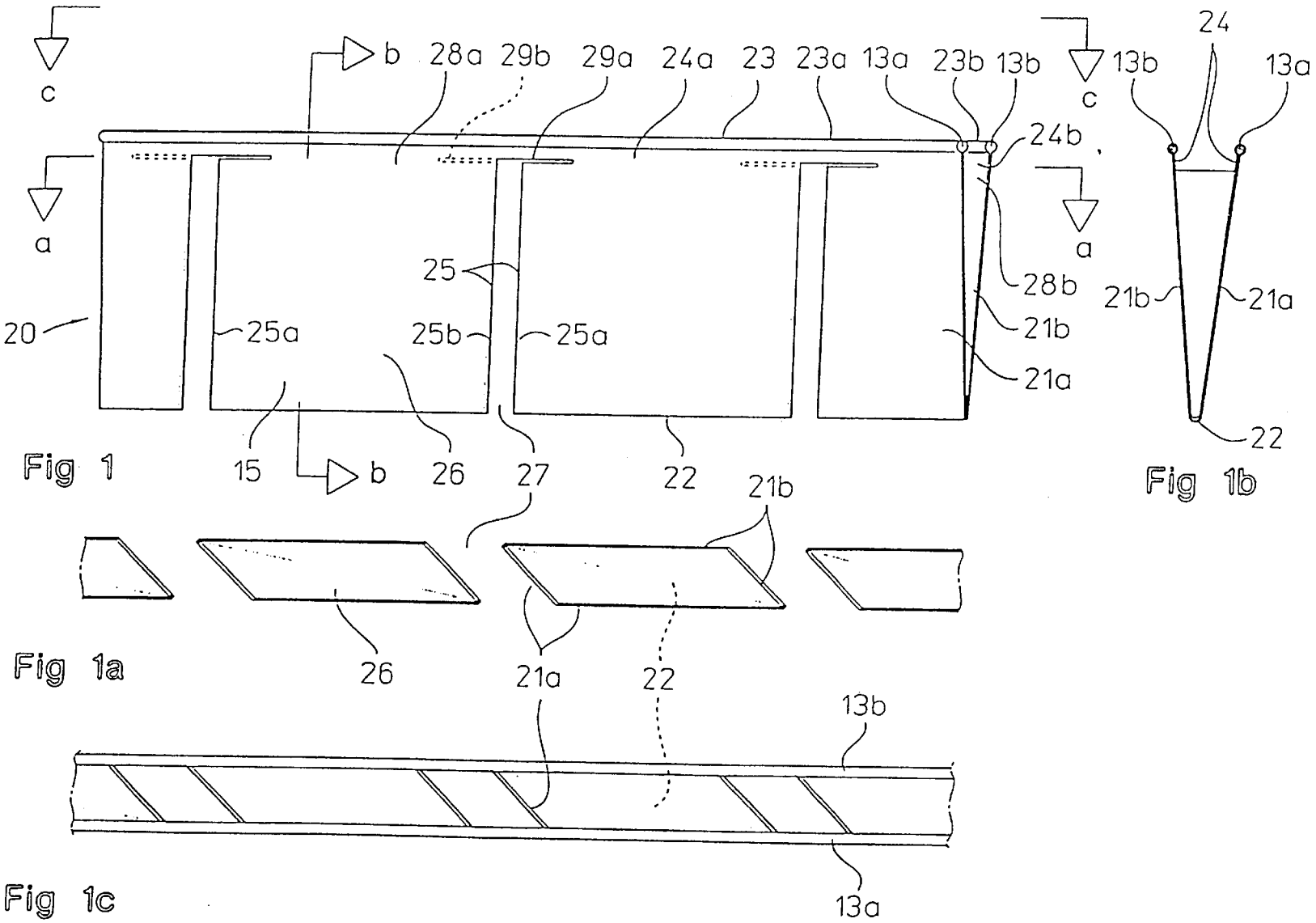
FIG. 1 is a perspective view of a portion of a web according to the present invention, with the retainer devices of the web designed as material thickened portions.
FIG. 1*a* is a section taken along the line A—A in FIG. 1.
FIG. 1*b* is a section taken along the line B—B in FIG. 1.
FIG. 1*c* is a section taken along the line C—C in FIG. 1.
Figure 2B:
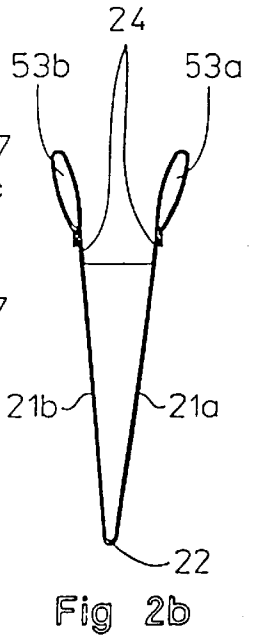
FIG. 2*b* is a section taken along the line B—B in FIG. 2.
Figure 2:
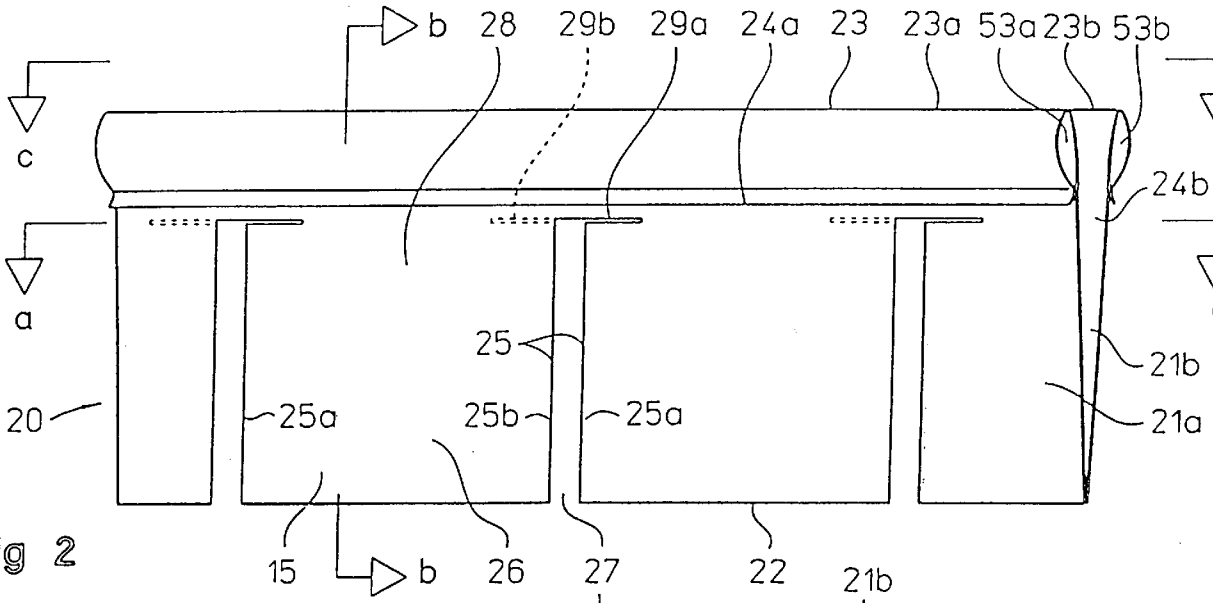
FIG. 2 is a perspective view of a portion of a web according to the present invention with the retainer devices of the web designed as tunnels.
Figure 2A:
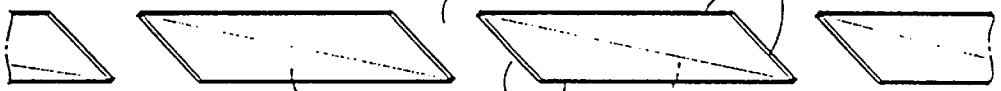
FIG. 2*a* is a section taken along the line A—A in FIG. 2.
Figure 2C:
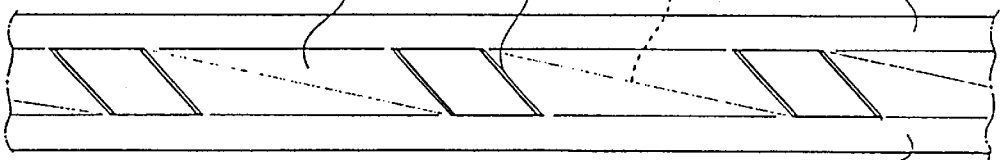
FIG. 2*c* is a section taken along the line C—C in FIG. 2.
Figures 3A, 3B, 3C:
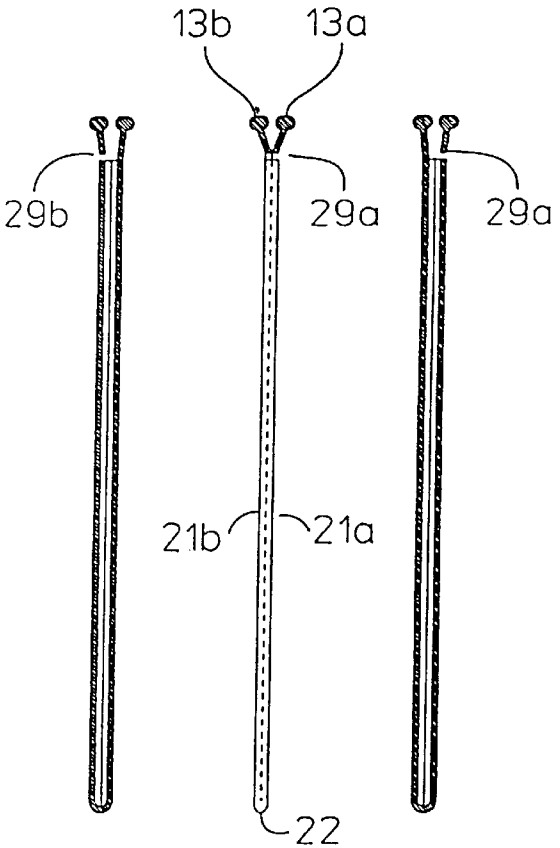
FIGS. 3*a–c* are sections taken along the lines A—A, B—B and C—C, respectively, in FIG. 3.
Figure 3:
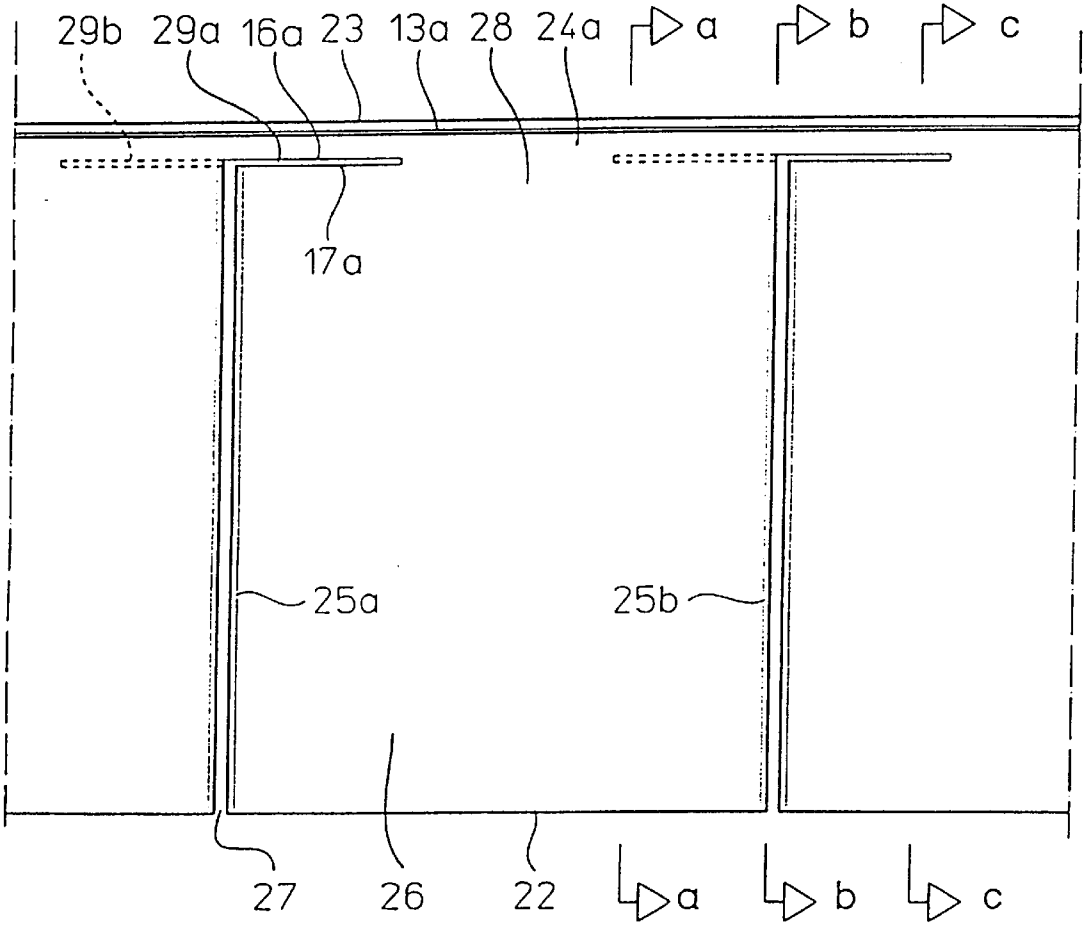
FIG. 3 is a side elevation of a portion of the web according to FIG. 1 with both walls of the web in abutment against one another.
Figures 4A, 4B, 4C:
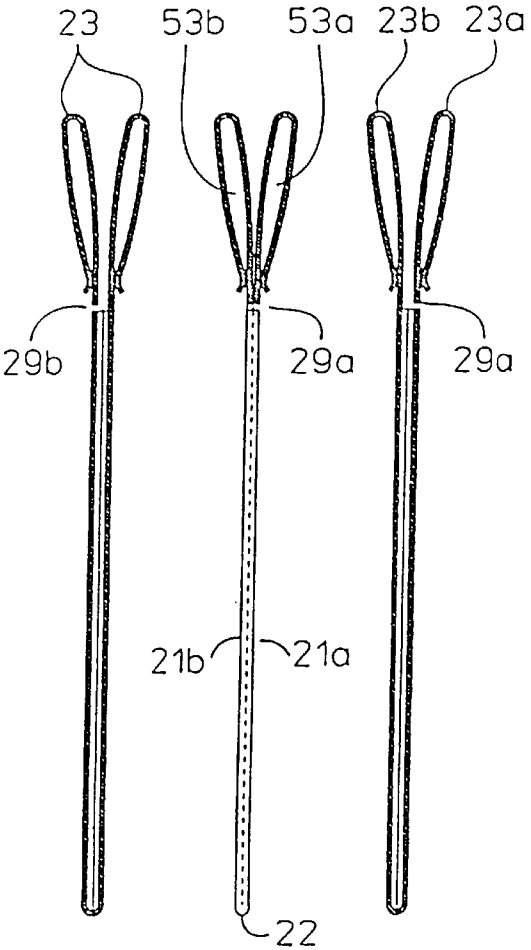
FIGS. 4*a–c* are sections taken along the lines A—A, B—B and C—C, respectively, in FIG. 4.
Figure 4:
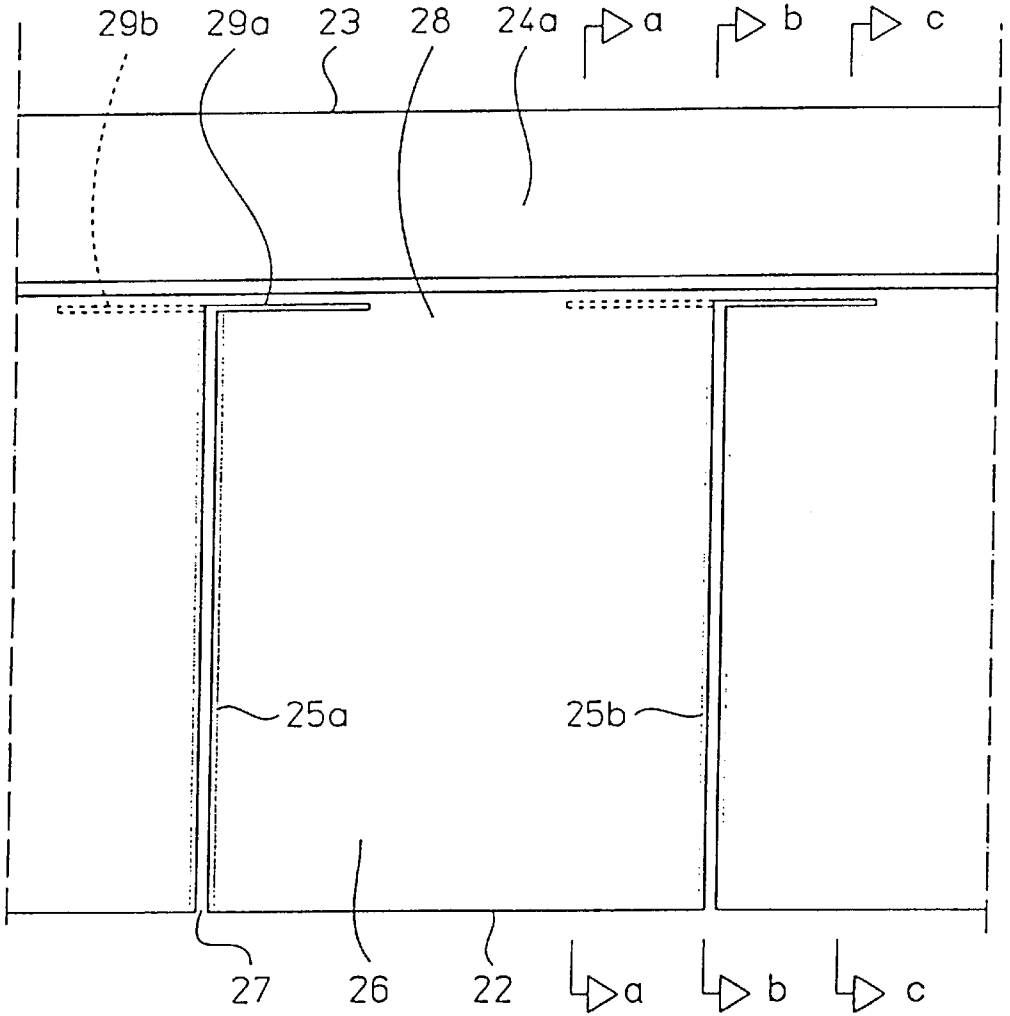
FIG. 4 is a side elevation of a portion of the web according to FIG. 2 with both walls of the web in abutment against one another.

FIGS. 1–5 show embodiments of a continuous web 20 of flexible material, generally plastic material or similar material. The expression "similar material" is taken to signify any material whatever possessing such properties that a web of the material is suitable for use in practical application of the present invention as described herein. The web displays two opposing walls 21*a,b*, hereinafter also referred to as the first wall 21*a* and second wall 21*b*, and first (lower) and second (upper) edges 22 and 23, respectively, located in the longitudinal direction of the web, which also includes a number of mutually sequentially disposed package blanks or pockets 26. The pockets each have a bottom portion 15 at said lower edge 22 and two connection zones or joints 25*a,b* which are transverse in relation to the longitudinal direction of the web and are occasionally designated transverse zones 25 or transverse joints 25, forming the side closures 25*a,b* of the pockets.

Figure 5B:
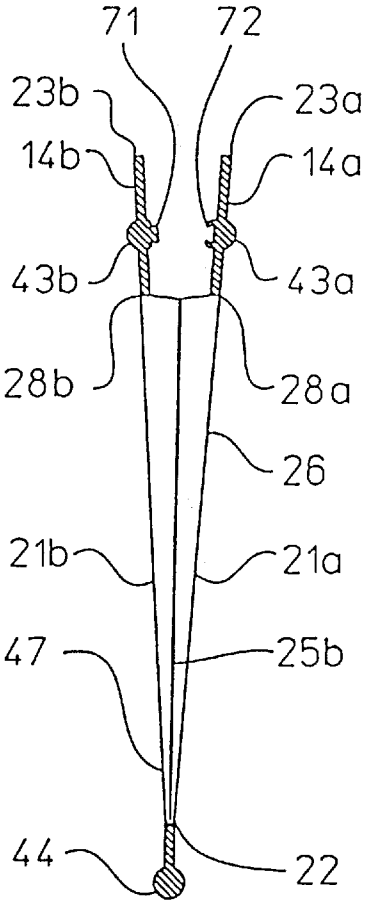
FIG. 5*b* is a section corresponding to the section B—B in FIG. 1, with a third retainer device disposed along the web.

In the Figures, the web is generally shown in embodiments in which the opposing walls 21*a,b* directly merge into one another in that the walls are folded over in the bottom portions 15 of the pockets in order to form the bottom of the pockets. It will be obvious to a skilled reader of this specification that, in other embodiments, both walls of the pockets form (as illustrated in FIG. 5*c* ) an inwardly folded bottom or are interconnected with one another, for example by means of a weld joint or seam which also forms the lower edge 22 of the web. Between the joints in two mutually adjacent pockets 26, there is a transverse slit 27 which defines the pockets from one another.

Each respective wall 21*a,b* includes two opposing edge portions 24*a,b* which extend in the longitudinal direction of the web at its above-mentioned upper edge 23. Each one of the edge portions includes continuous retainer means 13*a,b*;43*a,b*;53*a,b* for cooperation with mechanical devices 33*a,b* (cf. FIGS. 6*a* and 6*b*) for guiding the edge portions 24*a,b* on movement of the web 20 into an apparatus 3 for filling contents into the pockets 26. In the embodiments illustrated in FIGS. 1,1*b*,1*c*, 3,3*a–c* and 5*a–c*, the retainer means are designed as thickened material portions 13*a,b*;43*a,b*, while in other embodiments, as shown in FIGS. 2,2*b*,4,4*a–c*, they consist of tunnels 53*a,b*.

Figure 5A:
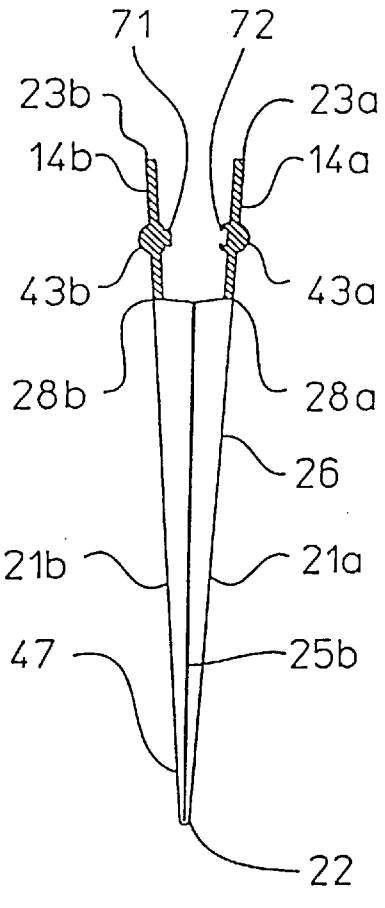
FIG. 5*a* is a section corresponding to the section B—B in FIG. 1 with an alternative design of the thickened portions of the web.
Figure 5C:
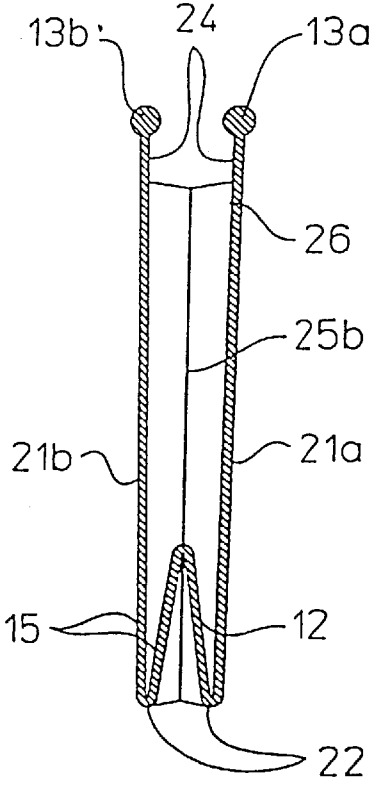
FIG. 5*c* is a section corresponding to the section B—B in FIG. 1, with a folded-in bottom of the web.

FIGS. 5*a,b* show one embodiment of the material thickened portions of the web in which the material thickening 43*a* of the one wall 21*a* is provided with a groove 72 oriented in the longitudinal direction of the web, and the material thickened portion 43*b* of the second wall 21*b* is provided with a bead 71 oriented in the longitudinal direction of the web. The bead and the groove form male and female parts which fit tightly into one another and are preferably of a configuration which forms a snap-in connection. FIGS. 5*a,b* also show an embodiment in which the web has been provided with strip-like wall portions 14*a,b* above the thickened portions 43*a,b*.

FIG. 5*b* also shows an embodiment of the web in which a second retainer means 44 is provided in the region of the first edge 22 of the web. The second retainer means is intended to be used for retaining the package formed by the packaging blank in connection with emptying of the package.

FIG. 5*c* shows one embodiment in which the bottom portions 15 of the pockets 20 form a crease (bottom crease) 12 inwardly folded in a direction towards the openings of the pockets.

In its end region located most proximal the retainer means 13*a,b*; 43*a,b*;53*a,b*, the transverse slit 27 merges into a longitudinal slit 29*a* in the first wall 21*a* directed to the right in the Figures, and a longitudinal slit 29*b* in the second wall 21*b* directed to the left. The longitudinal slits are located beneath the retainer means 13*a,b*;43*a,b*; 53*a,b*. The slit 29*a* of the first wall 21*a* is defined by an upper edge 16*a* and a lower edge 17*a*, while the slit 29*b* of the second wall 21*b* is defined by an upper edge 16*b* and a lower edge 17*b*.

Reference numerals 28*a,b* refer to those material portions of the web in which the opposing walls of the web are interconnected with one another for closure of the filled package blanks, for example by weld seams or joints. In certain practical applications, the interconnection of the walls takes place in a region beneath the slits 29*a,b*, while, in other applications, the welding together takes place in the region of the slits 29*a,b*. On welding together in the slits, a complete and tight connection will be achieved because of the fact that, at each slit, the wall which opposes the slit is unbroken (has no slit). A complete and tight welding together is effected close to the second (upper) edge of the web, whereby material consumption is reduced for each package which is filled and closed.

Figure 6:
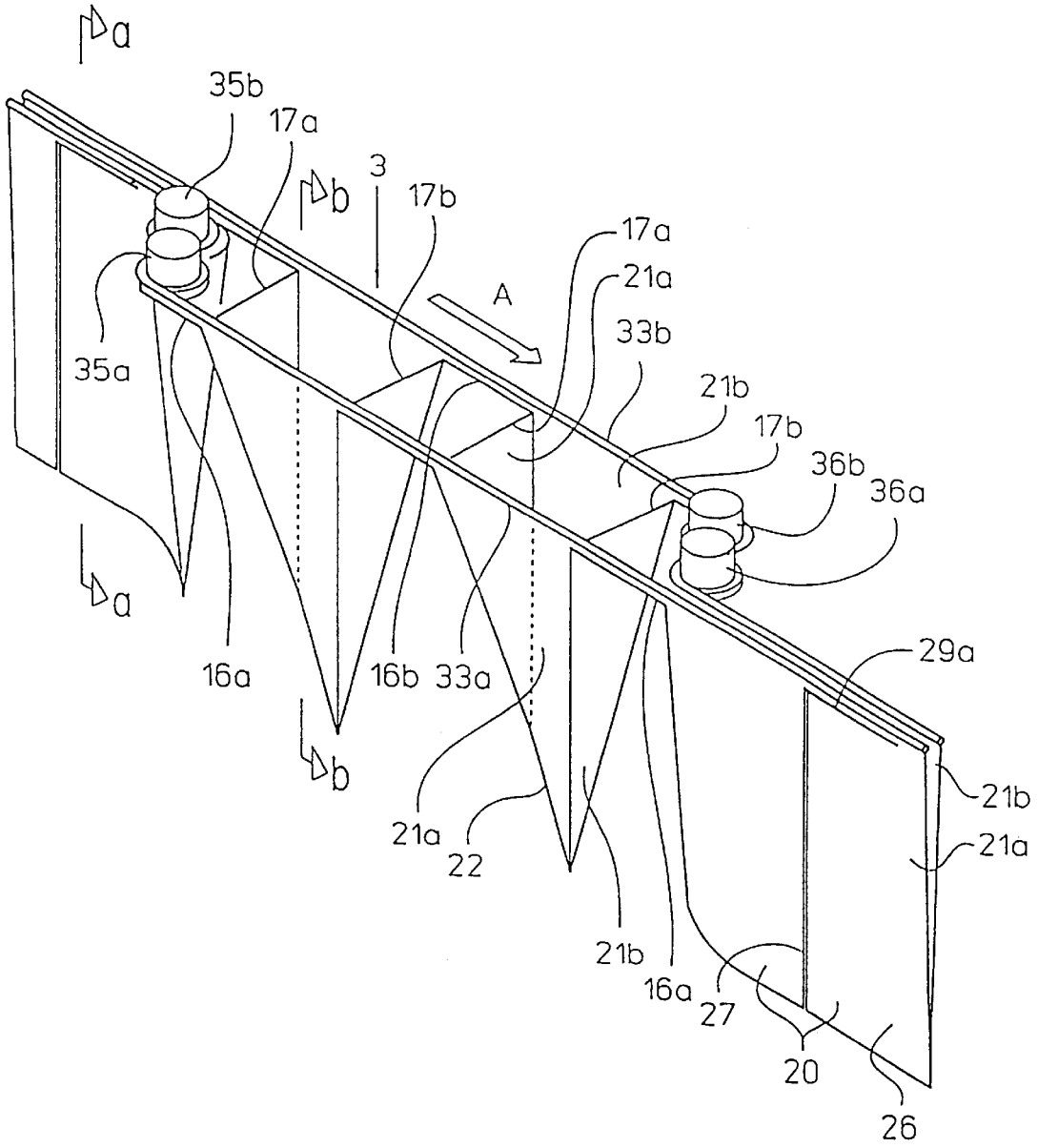
FIG. 6 is a schematic view in perspective of a filling apparatus and a web in position in the filling apparatus.
Figure 6B:
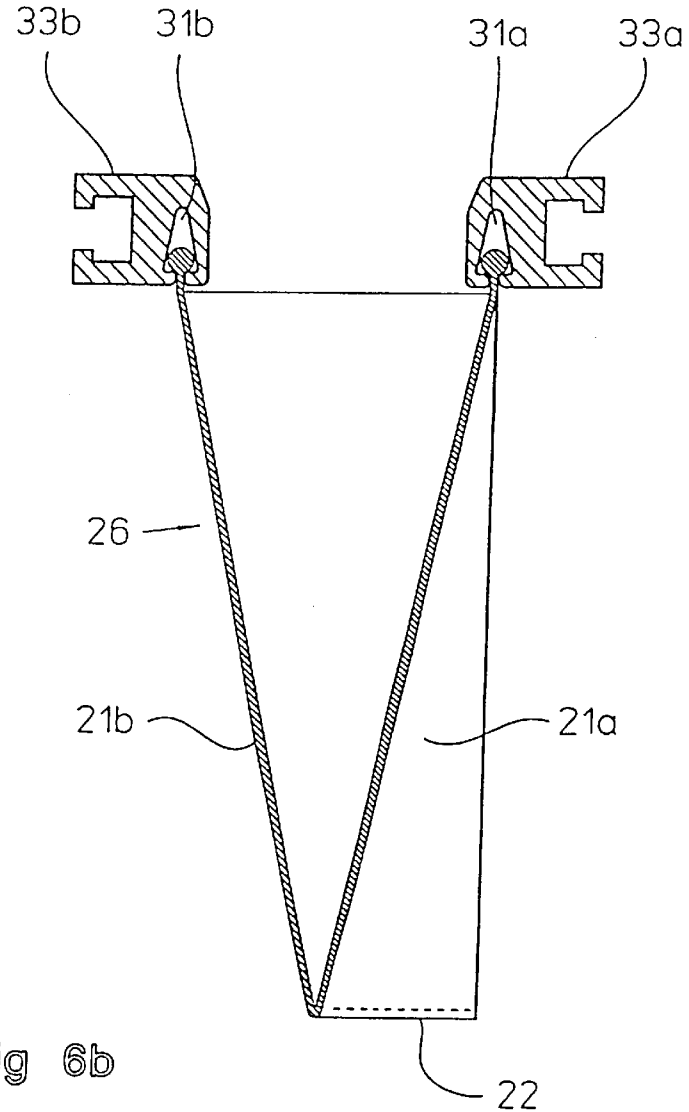
FIG. 6*b* is a section taken along the line B—B in FIG. 6.
Figure 7:
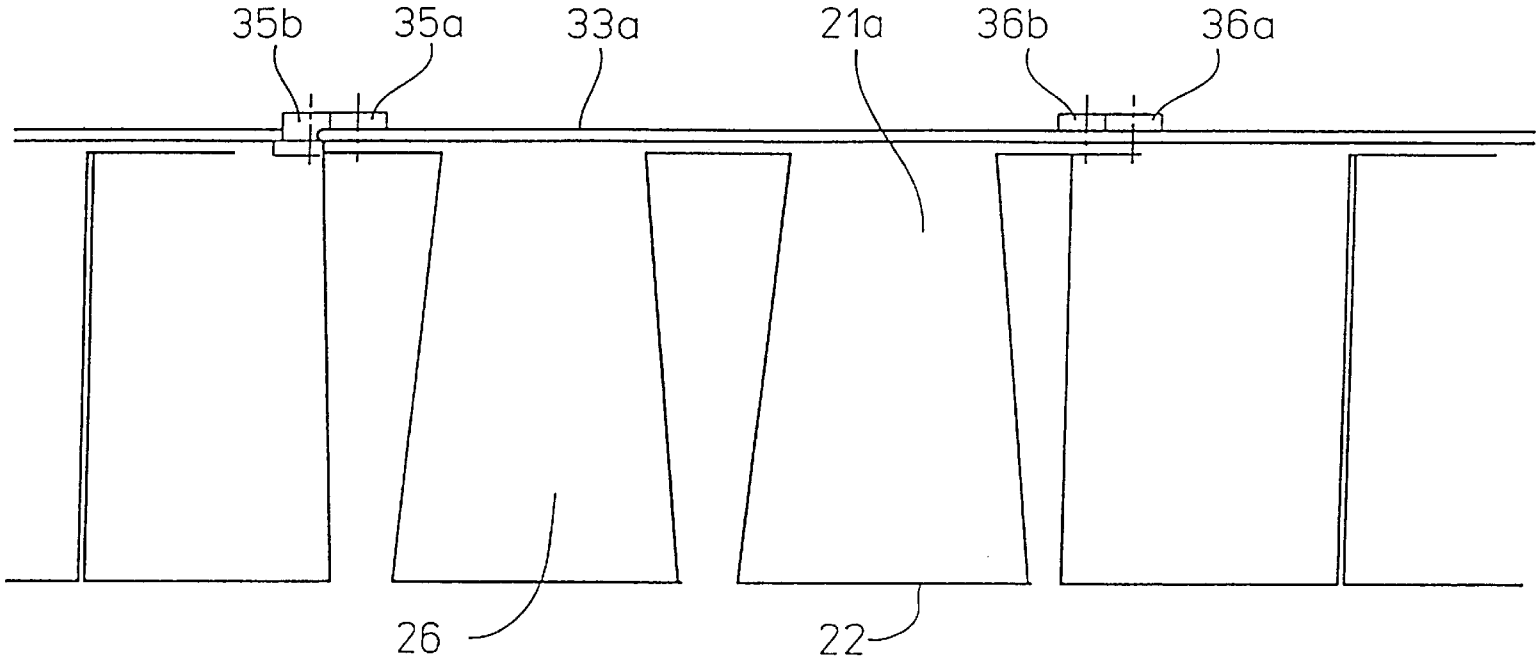
FIG. 7 is a side elevation of the filling apparatus and the web according to FIG. 6.
Figure 8:
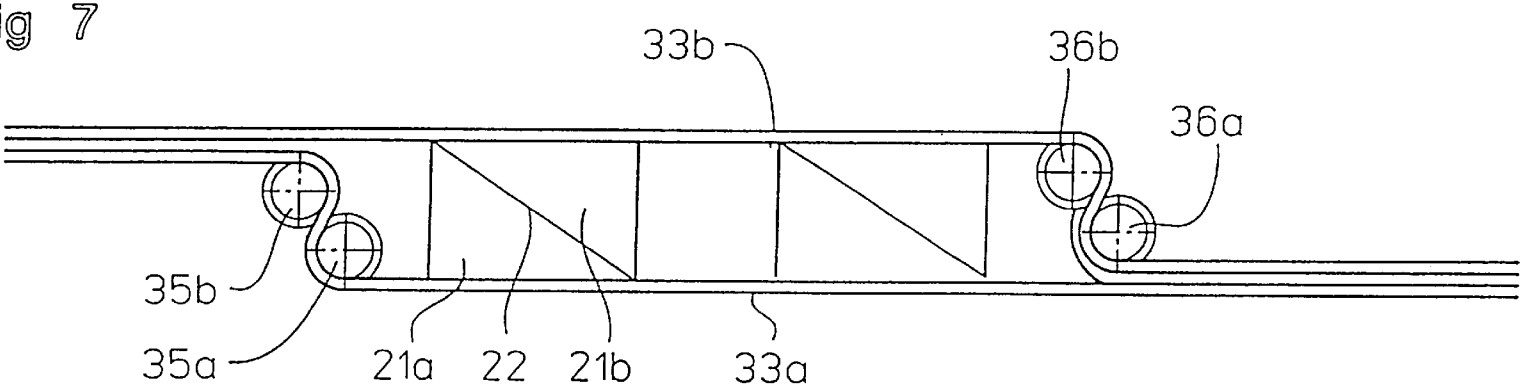
FIG. 8 is a top plan view of the filling apparatus and the web according to FIG. 6.

FIGS. 6–8 show one embodiment of a filling apparatus 3 in which a web which includes retainer means 13*a,b*;43*a,b* provided as material thickened portions, are displaced in the direction of the arrow A along the mechanical retainer devices 33*a,b* of the filling apparatus. It will be apparent from the Figure that, on entry into the filling apparatus, the retainer means 13*a*,43*a* are guided, at the first wall of the web 21*a*, by mechanical guide means 35*a,b* to proceed a longer distance than the retainer means 13*b*,43*b* of the second wall 21*b* of the web. At the same time, the retainer means of the web are displaced from one another to a distance at most corresponding to the length of the longitudinal slits 29*a,b*. Hereby, the pockets will be opened. The openings which are formed consist of rectangles, as a rule parallelograms. The angles which are formed are determined by the distance between the mechanical retainer devices of the filling apparatus. At maximum spacing between the retainer means of the web, i.e. a distance substantially corresponding to the length of the longitudinal slits, the openings form right-angled rectangles.

On exit from the filling apparatus, the retainer means 13*b*,43*b* of the second wall 21*b* are guided by mechanical guide members 36*a,b* so as to proceed a longer distance than the retainer means 13*a*,43*a* of the first wall 21*a* of the web. The longer distance the retainer means 13*a*,43*a*,53*a* of the first wall 21*a* are moved on entry into the filling apparatus is compensated for by the shorter distance by which the retainer means of the first wall are displaced on exit. This entails that both walls 21*a,b* of the web after exit of the web from the filling apparatus assume the same relative positions in the longitudinal direction of the web as before entry into the filling apparatus. The desired effect will hereby be attained that the opposing walls of the pockets after exit from the filling apparatus assume positions where they are no longer moved in relation to one another in a longitudinal direction of the web. As a result, on the displacement out of the filling apparatus, the walls 21*a,b* of the web 20 are moved to positions adjacent one another, i.e. to positions in which a reliable and wholly acceptable closure and seaming of the pockets takes place in that the walls 21*a,b* are connected in the material portions 28*a,b*.

It will be obvious to a person skilled in the art that the size of the openings of the package blanks may simply be adapted to current needs by suitable dimensioning of the web and of the length of the longitudinal slits in the web at the same time as the desired configuration of the openings of the package blanks on supply of contents may simply be regulated by an adjustment of the distance between the retainer devices of the filling apparatus.

A further advantage inherent in the new technique as herein disclosed is that, in the embodiment of the filling apparatus shown on the Drawings, only one of the retainer devices of the filling apparatus need be moved to a new position when adapting the distance between the retainer devices in connection with switching to a web of other dimensions than those which the filling apparatus is set to handle.

Figure 6A:
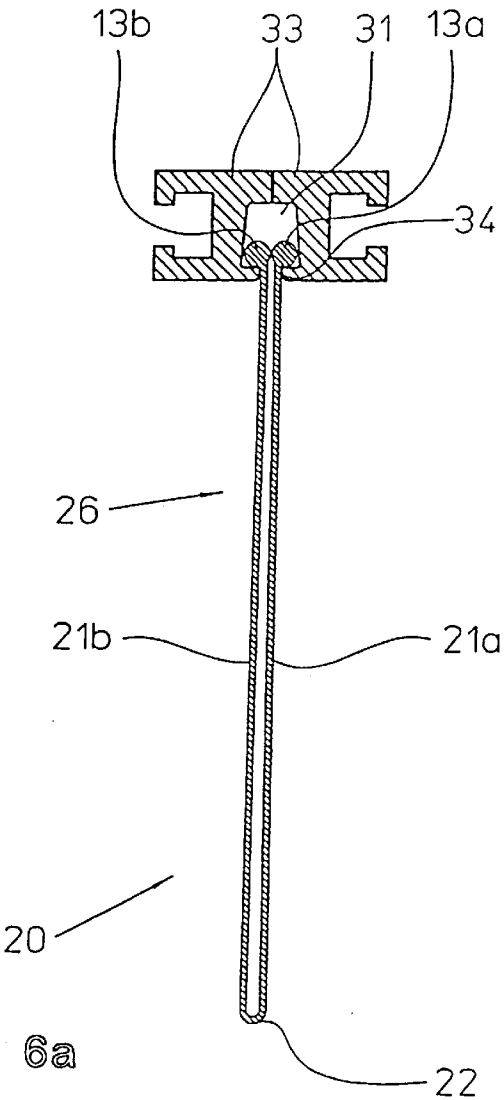
FIG. 6*a* is a section taken along the line A—A in FIG. 6.

In FIGS. 6*a,b*, the mechanical retainer devices 33*a,b* of the filling apparatus are shown as suspension devices for the retainer means 13*a,b*; 43*a,b* of the web when these are formed as material thickened portions. The mechanical retainer devices 33*a,b* are, in the region where the pockets 26 are supplied with contents, each provided with their channel 31*a,b*. Each respective channel is dimensioned to accommodate the material thickened portion 13*a,b* of one of the walls. Each one of the channels 31*a,b* is provided with a longitudinal gap 34*a,b* of a minimum extent in the transverse direction which is less than the width of the thickened portion 13*a,b* of each respective web wall 21*a,b*. As a rule, the mechanical devices are oriented such that the web depends down through the gaps 34*a,b* of the mechanical devices 33*a,b* during displacement therealong. Other orientation of the mechanical devices and of the web are employed in other applications of the present invention.

In the foregoing description, use has occasionally been made of the designations upper, lower, right, left, etc. These designations have been employed merely to facilitate presentation of the invention. It will, however, be obvious to a person skilled in the art that the technique described above generally permits any optional orientation of the web in space.

The above-detailed description has referred to but a limited number of embodiments of the present invention, but a person skilled in the art will readily perceive that the present invention accommodates a large number of embodiments without departing from the spirit and scope of the appended claims.

What is claimed is:

1. An apparatus for filling successive package blanks of a continuous web which is longitudinally advanced through a filling region in which opposite walls of the package blanks are displaced to open the package blank and enable the opened package blanks to be filled, the filling region having an inlet end for entry of the package blanks and an outlet end for exit of the now filled package blanks, said apparatus comprising mechanical retainer devices for engaging retainer means at upper end portions of opposing walls of the package blanks so that said package blanks are suspended by said mechanical retainer devices, said mechanical retainer devices being laterally spaced apart in said filling region between said inlet and outlet ends to open said package blanks to enable the filling thereof, first and second mechanical guide means for respectively guiding the retainer means of the package blanks at the inlet and outlet ends of the filling region, said first mechanical guide means at said inlet end being constructed to provide longitudinal displacement between the retainer means of one wall of each said package blank and the retainer means of the other wall of the same package blank in the filling region so that said opposite walls are both transversely and longitudinally spaced apart when the package blanks are being filled, said second mechanical guide means at said outlet end of the filling region being constructed to compensate for the relative longitudinal displacement of said walls to return said walls of the package blanks into their original opposing relation with one another wherein said first guide means at said inlet end of the filling region advances said one wall of the package blank along a longer path than the other wall of the package blank to a position at which the walls are spaced both laterally and longitudinally.

2. The apparatus of claim 1, wherein said second guide means at said outlet end of the filling region advances said other wall of the package blank along a longer path than said one wall to return said walls to their original opposed relation before entering the filling region.

3. The apparatus of claim 2, wherein each said package blank has longitudinal slits in said walls at side closures of the package blank, said slits extending in opposite directions in said walls in a region proximate said upper ends thereof, said mechanical guide means acting on said walls to provide a twist at the upper ends of the walls so said walls are opened.

4. The apparatus of claim 3, wherein the longitudinal slit in one wall of each said package extends longitudinally in one direction from one side closure while the longitudinal slit in the other wall extends longitudinally in the opposite direction from the opposite side closure.

5. The apparatus of claim 4, wherein the length of said slits and the longitudinal displacement of said one wall with respect to the other wall of said package blank are such that a substantially rectangular opening is provided at the upper end of the package blank for filling of the package blank.

6. The apparatus of claim 1, wherein said mechanical retainer devices have a lateral spacing which is not greater than the length of a longitudinal slit.

* * * * *